US008630440B2

(12) United States Patent
Dickie

(10) Patent No.: US 8,630,440 B2
(45) Date of Patent: Jan. 14, 2014

(54) LOUDSPEAKERS

(75) Inventor: Laurence Dickie, Brighton (GB)

(73) Assignee: Blast Loudspeakers Ltd., Brighton, East Sussex (GB)

( * ) Notice: Subject to any disclaimer, the term of this patent is extended or adjusted under 35 U.S.C. 154(b) by 2672 days.

(21) Appl. No.: 11/136,014

(22) Filed: May 23, 2005

(65) Prior Publication Data

US 2006/0000666 A1 Jan. 5, 2006

(30) Foreign Application Priority Data

May 24, 2004 (GB) ..... 0411564.8

(51) Int. Cl.
*H04R 25/00* (2006.01)

(52) U.S. Cl.
USPC ..... 381/398; 381/430; 381/423; 381/424; 381/426; 181/171; 181/172; 181/173

(58) Field of Classification Search
USPC ..... 381/401, 402, 407, 405, 413, 423, 424, 381/398, 430, 426; 181/171, 172, 173
See application file for complete search history.

(56) References Cited

U.S. PATENT DOCUMENTS

| | | | | |
|---|---|---|---|---|
| 4,488,010 | A | 12/1984 | Klein | 179/110 |
| 4,531,608 | A | 7/1985 | Heinz | |
| 4,661,973 | A | 4/1987 | Takahashi | |
| 6,359,996 | B1 * | 3/2002 | Ohashi | 381/401 |
| 6,578,661 | B2 * | 6/2003 | Ohashi et al. | 181/161 |
| 7,177,439 | B2 | 2/2007 | Tardo et al. | |
| 2001/0043713 | A1 | 11/2001 | Tokusho et al. | 381/398 |
| 2003/0070869 | A1 | 4/2003 | Hlibowicki | 181/172 |
| 2007/0297640 | A1 * | 12/2007 | Ohashi et al. | 381/430 |

FOREIGN PATENT DOCUMENTS

| | | | |
|---|---|---|---|
| DE | 1281600 | | 10/1968 |
| DE | 39 17 477 | A1 | 12/1990 |
| GB | 308801 | | 8/1930 |
| GB | 334350 | | 9/1930 |
| GB | 2 113 041 | A | 7/1983 |
| JP | 10-175498 | | 6/1998 |
| JP | 2003348691 | A * | 12/2003 |

OTHER PUBLICATIONS

UK Search Report for Serial No. GB0411564.8 dated Feb. 1, 2005.
European Search Report for EP 05253173 dated Sep. 19, 2008.

* cited by examiner

*Primary Examiner* — Davetta W Goins
*Assistant Examiner* — Jasmine Pritchard
(74) *Attorney, Agent, or Firm* — McCormick, Paulding & Huber LLP

(57) ABSTRACT

A loudspeaker 2 comprises a dome 16 whose edge is stiffened by a carbon fiber ring 20. The dome 16 is shaped as a catenary or parabola.

15 Claims, 2 Drawing Sheets

LOUDSPEAKERS

CROSS-REFERENCE TO RELATED APPLICATIONS:

Applicant hereby claims foreign priority benefits under U.S.C. §119 from United Kingdom Patent Application No. 0411564.8, filed on May 24, 2004 the contents of which are incorporated by reference herein.

FIELD OF THE INVENTION

The present invention relates to improvements in loudspeakers.

In a first aspect the application proposes an improved dome construction, particularly, but not exclusively, for high frequency loudspeakers.

BACKGROUND OF THE INVENTION

In a known design, a dome is mounted at its periphery to a support through a flexible surround which allows the dome to move axially. The edge of the dome is also coupled to a voice coil mounted in the gap between the poles of a permanent magnet, movement of the dome being caused by changes in the polarity of the electrical supply to the voice coil. Typically the dome is metallic, e.g. aluminum, and the voice coil is wound on a polymeric former suitably attached to the dome.

At low frequencies, the dome, subjected to a cyclic force from the voice coil, behaves as a rigid body with all points on its surface moving with the same axial velocity. At some higher frequency, known as the first break-up mode, however, the structure will exhibit a resonant mode where the central part of the dome moves axially while the edge of the dome moves radially. This point marks the high frequency limit of the driver and the aim of the loudspeaker designer is to maximize this value.

SUMMARY OF THE INVENTION

The dome profile used by most manufacturers has traditionally been spherical. However, the Applicant has recognized that this is not optimum from the point of view of first mode break up, and in fact the ideal shape is that of a catenary or parabola.

From a first aspect therefore, the invention provides a loudspeaker dome having a substantially parabolic or catenary shape.

Preferably the profile of the dome matches that of a catenary or parabola to within 1.5%, more preferably 1%, more preferably 0.5% over its diameter. By this is meant that the profile of the dome should lie not more than ±1.5%, more preferably ±1%, more preferably ±0.5%, of the dome height away from the catenary or parabola which passes through two points which define the diameter of the dome and the central point which defines the dome height.

It has also been found that in order to optimize the performance of such a dome, the edge region of the dome should be stiffened Preferably the dome is stiffened by a stiffening ring suitably attached to the dome. Preferably the ring is of a high modulus carbon fiber, as that provides excellent stiffness, but low weight.

Preferably the ring has a stiffness of 5000/(dome diameter in meters) $Nm^{-1}$. Preferably also it has a cross sectional area of more than about 0.002% of the dome area. Preferably the Young's Modulus of the ring will be over 300 $GNm^{-2}$, typically 800 $GNm^{-2}$.

Preferably the ring is attached to the dome at a position no more than 10%, more preferably no more than 5% of the dome diameter inwardly from the dome edge. Preferably the ring is bonded to the dome. More preferably, the ring is formed in situ onto the dome. In a preferred embodiment, a suitable stiffening material, such as carbon fiber, may be laid into an adhesive deposited onto the dome. Preferably the adhesive, when cured, is at least slightly resilient so as to give better damping.

The stiffening may be applied either to the internal or external face of the dome. In a particularly preferred embodiment, the ring is formed in an internal corner of the dome.

The dome can be made from any suitable material, but preferably it is metallic. Most preferably the dome is made from aluminum, titanium or magnesium.

Preferably the dome is anodized, most preferably to a depth of over 5% of the dome thickness.

Preferably the dome will have a thickness of less than 0.1% of its diameter. Typically therefore, the dome will be between 25 and 75 microns thick.

In another aspect, the present application proposes a magnet design for a loudspeaker which is also particularly, but not exclusively, suited to high frequency loudspeakers.

As discussed above, a loudspeaker operates through the movement of a voice coil in a magnetic gap. The transduction efficiency of the loudspeaker is related to the flux in the magnetic gap and, particularly for high frequency drivers, a high value is desirable.

Most magnet systems employ a permanent magnet together with soft iron pole to channel and concentrate the flux in the magnetic gap in which the voice coil is located. Major problems arising in the design of high flux systems are the saturation of the iron and the leakage of flux from all the iron surfaces not in the gap. The issue of leakage is most acute where the steelwork is closest together just outside the gap.

Simply increasing the size of the magnet can only deal with problem up to a point, as the area of associated steel pole material increases, with attendant losses.

In a high frequency driver magnet system there is often found a space adjacent to the gap which tapers from the magnet width to the gap width and this region is one of the worst for flux leakage. The applicant has recognized that the gap flux can be significantly improved if that space is filled, at least in part, by magnetic material.

From a second aspect, therefore, the invention provides a magnet construction for a loudspeaker, comprising: a magnet; an inner pole; an outer pole spaced radially from said inner pole so as to define a space therebetween; said space having a first part defining a relatively narrow magnetic gap for receiving a voice coil of the loudspeaker, and a second, wider part receiving said magnet; said first part and second part being joined by a tapering part which also receives a magnetic material.

The additional magnetic material may be separate from or formed as part of the main magnet of the construction.

The additional magnetic material may extend as close to the magnetic gap as is allowed by the movement of the coil in the gap.

This aspect of the invention is particularly applicable to systems using magnetic materials having a high coercivity and high energy product such as neodymium iron boron.

BRIEF DESCRIPTION OF THE DRAWINGS

Some preferred embodiments of the invention will now be described by way of example only with reference to the accompanying drawings in which.

DETAILED DESCRIPTION OF THE PREFERRED EMBODIMENTS

Figure 2:
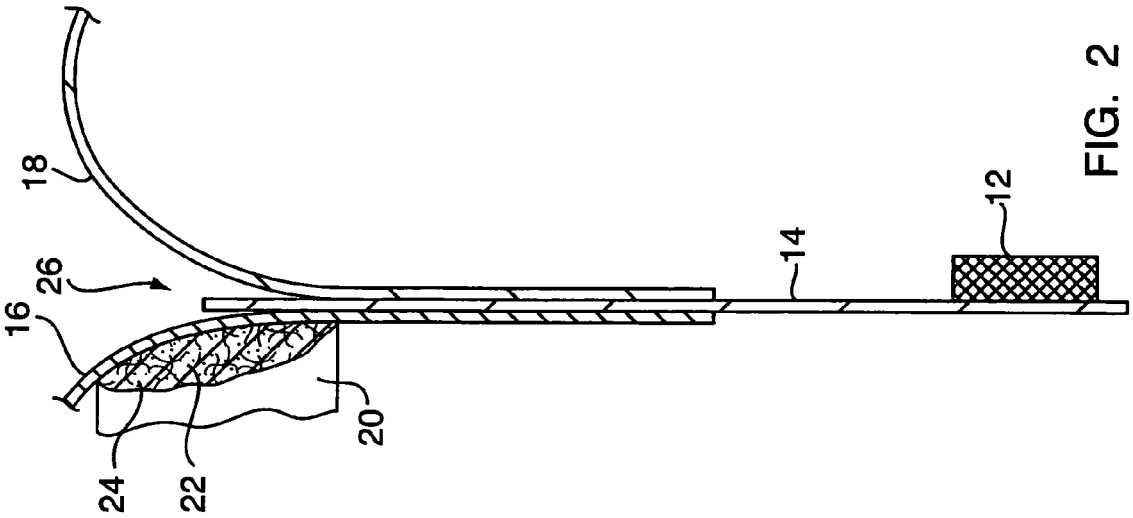
FIG. 2 shows a detail of the construction of FIG. 1.
Figure 1:
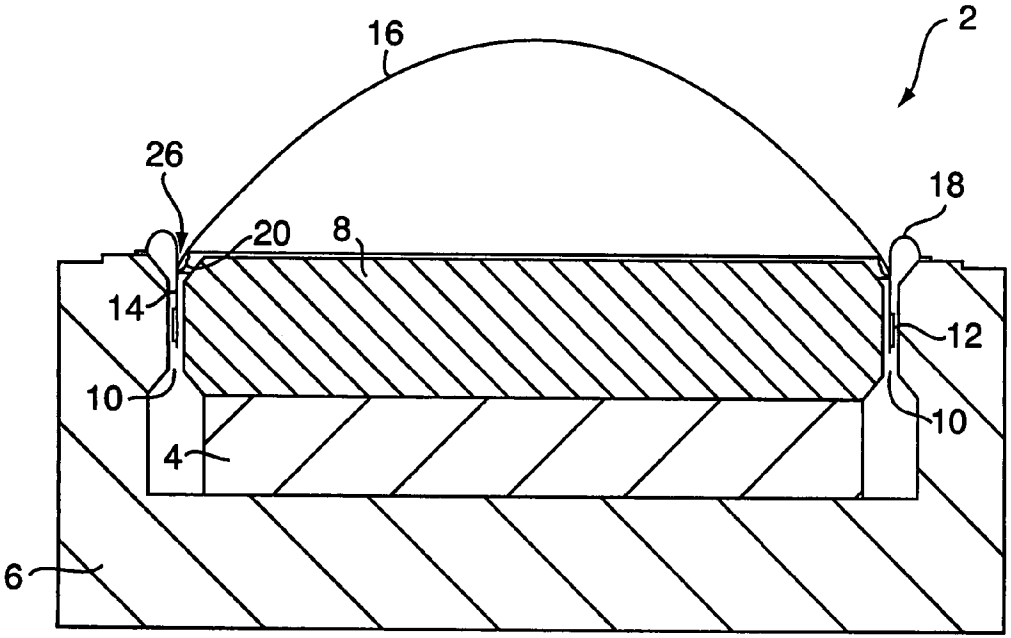
FIG. 1 shows a first embodiment of the invention.

With reference to FIGS. 1 and 2, a high frequency loudspeaker driver 2 comprises a magnet 4, a steel shell 6 and a steel pole 8. A magnetic gap 10 is formed between the steel shell 6 and steel pole 8, and this gap receives a voice coil 12 which is formed on a coil former 14 attached to a dome 16. The dome 16 is mounted to the steel shell 6 by a resilient support member 18 which is bonded to the dome and suitably supported on the shell 6. As described so far, this is a conventional construction.

The dome 16, however, is not of a conventional construction. In the embodiment shown, the dome 16 is shaped as a catenary, as opposed to the standard spherical shape. (i.e. a vertical section through the dome has a catenary shape). The dome profile can lie within a +/−1% band of the ideal curve, i.e. lie between a pair of limit curves created by offsetting the ideal catenary curve passing through the edge of the dome and its center by +/−1% of the central dome height. In addition, the periphery of the dome 16 is stiffened by a ring 20 of carbon fiber positioned internally of the dome 16 at the base of the dome 16.

The carbon fiber ring 20 is formed in situ on the dome 16. In this particular embodiment, for a 50 mm diameter dome, two turns of 1000 tex carbon fiber toe 22 having a Young's Modulus of 800 $GNm^{-2}$ are wound into a PVA adhesive matrix 24 at the base of the dome 16 and the adhesive allowed to cure. The resultant ring 20 has a cross sectional area of over 0.05 $mm^2$ and a stiffness of 100,000 $Nm^{-1}$. The PVA adhesive is preferred as it provides better damping than a more rigid matrix.

The dome itself is 50 mm in diameter and is formed from anodized aluminum, with a thickness of 50 microns.

While a prior art 50 mm dome might have a first mode at 13 kHz, it has been found that the first mode of a dome as described above can exceed 21 kHz, a very significant increase.

It will be appreciated that various modifications can be made to the above embodiment without departing from the scope of the invention. For example, the stiffening ring 20 may be placed externally of the dome 16, for example in the region 26 between the dome 16 and the resilient support 18. Also, other materials may be used to form the stiffening ring 20. Carbon fiber is preferred however due to its high stiffness and low weight. Also, the area of stiffening material laid down will depend on the modulus of that material. A lower modulus material will require a greater area to give the desired stiffness to the dome periphery. Also, the dome 16 may have a parabolic, rather than a catenary profile.

Figure 3:
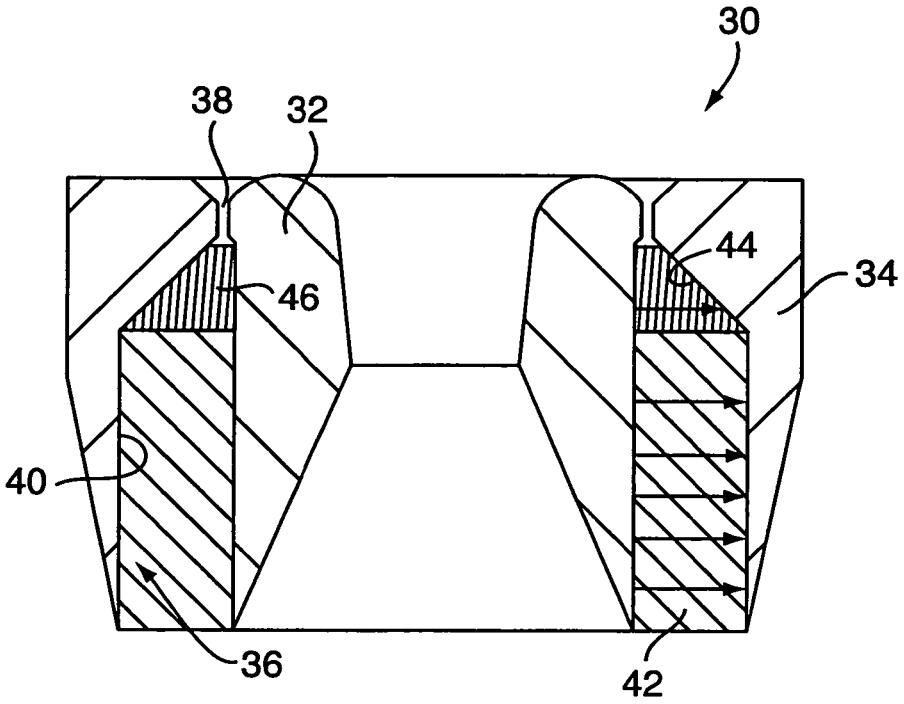
FIG. 3 shows a second embodiment of the invention.

Turning now to FIG. 3, this illustrates a magnet construction 30. The construction comprises an inner steel pole 32 and an outer steel pole 34 spaced radially outwardly from the inner pole 32. The poles 32, 34 are typically of low lead steel. A space 36 is defined between the two poles 32, 34.

The space 36 has a first portion 38 at one end which forms a magnetic gap to receive a voice coil (not shown). The space 36 also has a rectangular second portion 40 which receives a radially polarized magnet 42, for example of a 35 MOe 150° C. sintered material. The space 36 also has a third portion 44 which tapers from the second portion 40 to the first portion 38.

As described so far this construction is conventional. However, in accordance with the invention the tapering space portion 44 receives additional magnetic material 46. This brings the magnetic material much closer to the magnetic gap 38, reducing flux losses in that region.

It has been found that in a prior art construction with a 26 mm pole diameter and gap dimensions of 0.7 mm×1.8 mm developing 2.2 T, the present invention will allow an increase of 0.2 T.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A loudspeaker having a dome having a substantially parabolic or catenary shape, wherein an edge region of the dome is stiffened, wherein the dome is stiffened by a ring suitably attached to the dome and the Young's Modulus of the ring is over 300 $GNm^{-2}$.

2. The loudspeaker according to claim 1 wherein a profile of the dome matches that of a catenary or parabola to within 1.5%, more preferably 1%, more preferably 0.5%, over its diameter.

3. The loudspeaker according to claim 1 wherein the ring is of a high modulus material, preferably carbon fiber.

4. The loudspeaker according to claim 1 wherein the ring has a stiffness of at least 5000/(dome diameter in meters) $Nm^{-1}$.

5. The loudspeaker according to claim 1 wherein cross sectional area of the ring is more than about 0.002% of the dome area.

6. The loudspeaker according to claim 1 wherein the ring is attached to the dome at a position no more than 10%, more preferably no more than 5% of the dome diameter inwardly from the dome edge.

7. The loudspeaker according to claim 1 wherein the ring is bonded to the dome by adhesive.

8. The loudspeaker according to claim 1 wherein the ring is formed in situ on the dome.

9. The loudspeaker according to claim 8 wherein a stiffening material, such as carbon fiber, is laid into an adhesive deposited onto the dome.

10. The loudspeaker according to claim 9 wherein the adhesive, when cured, is at least slightly resilient.

11. The loudspeaker according to claim 1 wherein the stiffening is applied to the internal face of the dome.

12. The loudspeaker according to claim 1 wherein the dome is metallic.

13. The loudspeaker according to claim 12 wherein the dome is made from aluminum, titanium or magnesium.

14. The loudspeaker according to claim 12 wherein the dome is anodized.

15. The loudspeaker according to claim 1 wherein the dome has a thickness of less than 0.1% of its diameter.

* * * * *